US011250998B2

(12) United States Patent
Feng

(10) Patent No.: US 11,250,998 B2
(45) Date of Patent: Feb. 15, 2022

(54) HAIR STRAIGHTENER AND INTEGRATED SWITCH FOR CONTROL AND DISPLAY

(71) Applicant: Shenzhen Lady Merry Technology Co., Ltd., Guangdong (CN)

(72) Inventor: Ye Feng, Guangdong (CN)

( * ) Notice: Subject to any disclaimer, the term of this patent is extended or adjusted under 35 U.S.C. 154(b) by 319 days.

(21) Appl. No.: 16/515,040

(22) Filed: Jul. 18, 2019

(65) Prior Publication Data

US 2020/0154845 A1 May 21, 2020

(30) Foreign Application Priority Data

Nov. 15, 2018 (CN) ..... 201821882672.X

(51) Int. Cl.

| | |
|---|---|
| ***A45D 2/00*** | (2006.01) |
| ***H01H 3/12*** | (2006.01) |
| ***H01H 1/58*** | (2006.01) |
| ***H01H 19/00*** | (2006.01) |
| *A45D 1/28* | (2006.01) |

(52) U.S. Cl.

CPC ..... *H01H 3/12* (2013.01); *H01H 1/5805* (2013.01); *H01H 19/005* (2013.01); *A45D 1/28* (2013.01); *H01H 2019/006* (2013.01)

(58) Field of Classification Search

USPC ..... 200/42.01

See application file for complete search history.

(56) References Cited

U.S. PATENT DOCUMENTS

2018/0000216 A1* 1/2018 Gonzalez ..... A45D 2/001
2018/0303217 A1* 10/2018 Pena ..... A45D 6/20

* cited by examiner

*Primary Examiner* — Toan T Vu
*Assistant Examiner* — Xuan Ly

(57) ABSTRACT

A hair straightener and its integrated switch for control and display are disclosed. The hair straightener comprises first and second clamping plate parts and the integrated switch for control and display arranged on an inner side of the second clamping plate part. The integrated switch for control and display comprises a temperature control knob assembly for regulating and controlling temperature, a display button assembly for displaying the temperature and turning on or off a power supply, and a control motherboard for digital display and electrical control. The temperature control knob assembly and the display button assembly are installed on the control motherboard. The temperature display, control and regulation functions, and the power supply switching on and off functions are centralized on the same switch key, such that the temperature can be controlled and regulated conveniently when operated by one hand and the visual information can be obtained without obstacles.

16 Claims, 5 Drawing Sheets

HAIR STRAIGHTENER AND INTEGRATED SWITCH FOR CONTROL AND DISPLAY

TECHNICAL FIELD

The present disclosure relates generally to a technical field of hairdressing apparatus, and more particularly, to a hair straightener and its integrated switch for control and display.

BACKGROUND

The hair straightener is an electronic product used for straightening hair by a high-temperature, which mainly straightens the curly hair by a surface of a metal or ceramic plate heated by a heater to generally have a uniform temperature about 180-300 degrees.

It becomes a popular trend that the current hair straightener is provided with temperature control function. However, there are not many hair straighteners provided with display screens which are mainly used for temperature display. Moreover, the hair straighteners with display screens on the market all place the display screens on the outer side of the handle. It is because that the display screen needs a relative large space comparing with the size of the hair straightener and it cannot be arranged too close to the heating end, so it is a reluctant option for the designer to arrange the display screen on the outer side of the handle. However, such design is not very practical in the use process, as the user's hands always block the screen during the actual use, and the user cannot observe the information on the screen to regulate temperature smoothly while operating. Accordingly, the operation is inconvenient, so the market penetration rate is not high. In addition, in order to achieve the functions of temperature control, the hair straightener should be provided with multiple keys, which is not conducive for one-handed operation.

Therefore, the existing technology needs to be improved and perfected.

SUMMARY

The object of the present application is to provide a hair straightener and its integrated switch for control and display which are provided with temperature display and convenient for operation, aiming at the shortcomings of the above existing technologies.

In one aspect, an integrated switch for control and display is provided, which comprising a temperature control knob assembly for regulating and controlling temperature, a display button assembly for displaying the temperature and turning on or off a power supply, and a control motherboard for digital display and electrical control; wherein the temperature control knob assembly and the display button assembly are installed on the control motherboard.

In a preferable embodiment, the display button assembly comprises a transparent/translucent display key, the control motherboard is provided with a digital display tube and the display key is positioned directly above the digital display tube.

Furthermore, the integrated switch for control and display further comprises an intermediate connecting member sleeved on the digital display tube and fixed on the control motherboard, wherein the display key is mounted on the intermediate connecting member.

Furthermore, the control motherboard is provided with a key switch element while the display key is provided with an abutting column for abutting the key switch element.

Furthermore, the display key is further arranged with a key buckle for fixing while the intermediate connecting member is corresponding arranged with a key clamping slot for a fit connection with the key buckle, wherein the key buckle is relatively slideable in the key clamping slot. Moreover, a spring for automatic restoring the display key is arranged between the display key and the intermediate connecting member. More preferably, two springs are symmetrically arranged at both sides of a lower part of the display key. More preferably, four pairs of key buckle and key clamping slot are symmetrically arranged.

In a preferable embodiment, the temperature control knob assembly is arranged with an accommodation space for accommodating the display button assembly.

In a preferable embodiment, the temperature control knob assembly further comprises a temperature control knob and an intermediate gear element; while the control motherboard is provided with a rotary coding switch element which is connected with the temperature control knob through the intermediate gear element.

Further, the intermediate gear element comprises a main gear and a secondary gear which are meshed with each other, wherein the secondary gear is provided with a polygonal prism inserted into the rotary coding switch element, the temperature control knob is fixed with the main gear, and both of the temperature control knob and the main gear are provided with a through-hole for accommodating the display key. The main gear and the secondary gear are arranged on the intermediate connecting member. More preferably, the intermediate connecting member further comprises a fixing cover arranged with a circular hole in which an upper end of the secondary gear is arranged. Furthermore preferably, the polygonal prism is a hexagon prism.

In a preferable embodiment, the intermediate gear element further comprises a hand-feeling gear mounted on the intermediate connecting member and meshed with the main gear. More preferably, the intermediate connecting member further comprises a fixing cover for fixing the main gear, the secondary gear and the hand-feeling gear.

According to a further aspect, a hair straightener is provided, which comprising a first clamping plate part, a second clamping plate part and the integrated switch for control and display discussed above, wherein the integrated switch for control and display is arranged on an inner side of the second clamping plate part.

Compared with the existing technology, the present application has provided a hair straightener and its integrated switch for control and display. In the present application, the hair straightener comprises a first clamping plate part, a second clamping plate part and the integrated switch for control and display discussed above, wherein the integrated switch for control and display is arranged on an inner side of the second clamping plate part. The integrated switch for control and display comprises a temperature control knob assembly for regulating and controlling temperature, a display button assembly for displaying the temperature and turning on or off a power supply, and a control motherboard for digital display and electrical control; wherein the temperature control knob assembly and the display button assembly are installed on the control motherboard. In the present application, the temperature display and temperature control and regulation functions are centralized on the same switch key which further combines the power supply switching on and off functions. Furthermore, by means of a knob assembly, the temperature can be regulated linearly, which makes the control range more elaborate, and improves the humanized setting of the product. On the basis of the knob temperature regulation, the micro display function is added, so that the user can obtain real-time visual information of the temperature change while regulating the temperature. The integration of the two functions further increases the humanized settings. The integration of power switch on and off functions with the basic temperature display function can control the power supply to be switched on or off by pressing the switch key, which gives one switch key multiple functions and further increases the humanized settings. In addition, the integrated switch for control and display is arranged on an inner side of the clamping plate part, such that the temperature of the hair straightener can be controlled and regulated conveniently when it is operated by one hand, and meanwhile the visual information of the real-time output temperature can be obtained without obstacles. In additional, when the power supply is turned on or off, there is no need to regulate the operation position again, which greatly improves the simplicity and convenience of the one-hand operation, thus improving the market competitiveness of the hair straightener.

DETAILED DESCRIPTION OF THE PREFERRED EMBODIMENT

To make the technical feature, objective and effect of the present application be understood more clearly, now the specific implementation of the present application is described in detail with reference to the accompanying drawings and embodiments.

It should be noted that when a part is referred to as "mounted" "fixed" or "arranged" on another part, it can be directly on another part or indirectly on such another part via a possibly and simultaneously presented middle part. When a part is referred to as "connected" to another part, it can be connected directly to another part or indirectly connected to such another part via a possibly and simultaneously presented middle part.

It should also be noted that the expressions of left, right, upper and lower directions in the embodiments of the present application are only relative concepts or refer to the normal use of the product, and should not be considered restrictive.

Figure 1:
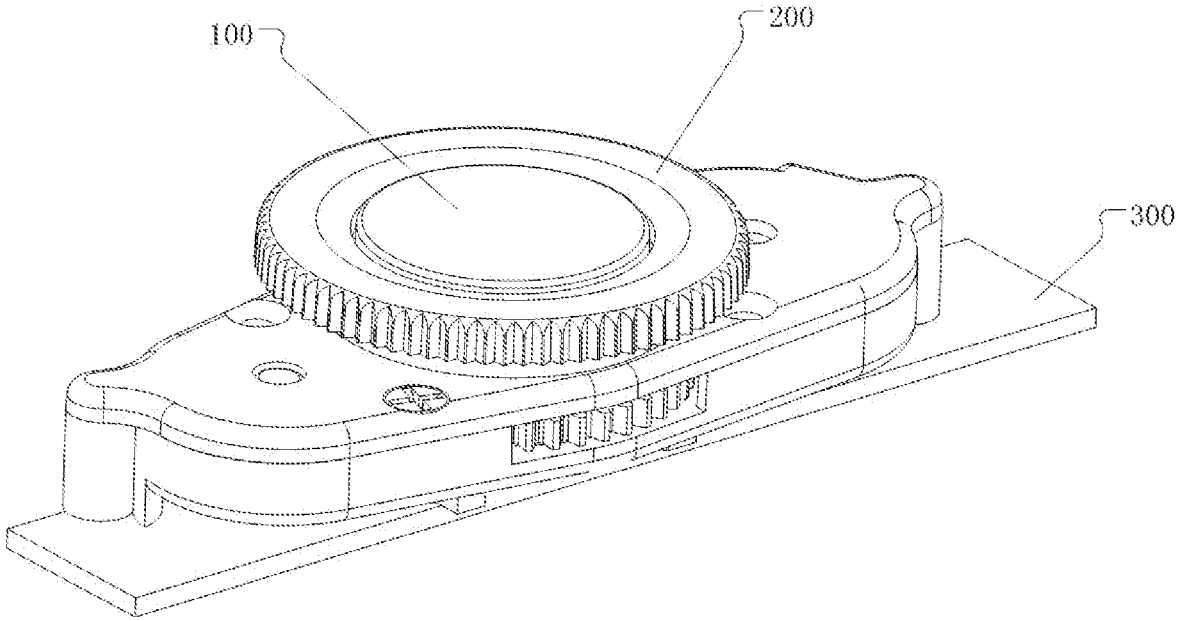
FIG. 1 is a schematic diagram of the integrated switch for control and display according to a first preferable embodiment of the present application.

As shown in FIG. 1, the present application has provided an integrated switch for control and display which comprising a temperature control knob assembly 200 for regulating and controlling temperature, a display button assembly 100 for displaying the temperature and turning on or off a power supply, and a control motherboard 300 for digital display and electrical control. The temperature control knob assembly 200 and the display button assembly 100 are installed on the control motherboard 300. In the present application, the temperature display and temperature control and regulation functions are centralized on the same switch key which further combines the power supply switching on and off functions. Furthermore, by means of a knob assembly, the temperature can be regulated linearly, which makes the control range more elaborate, and improves the humanized setting of the product. On the basis of the knob temperature regulation, the micro display function is added, so that the user can obtain real-time visual information of the temperature change while regulating the temperature. The integration of the two functions further increases the humanized settings. The integration of power switch on and off functions with the basic temperature display function can control the power supply to be switched on or off by pressing the switch key, which gives one switch key multiple functions and further increases the humanized settings.

Figure 2:
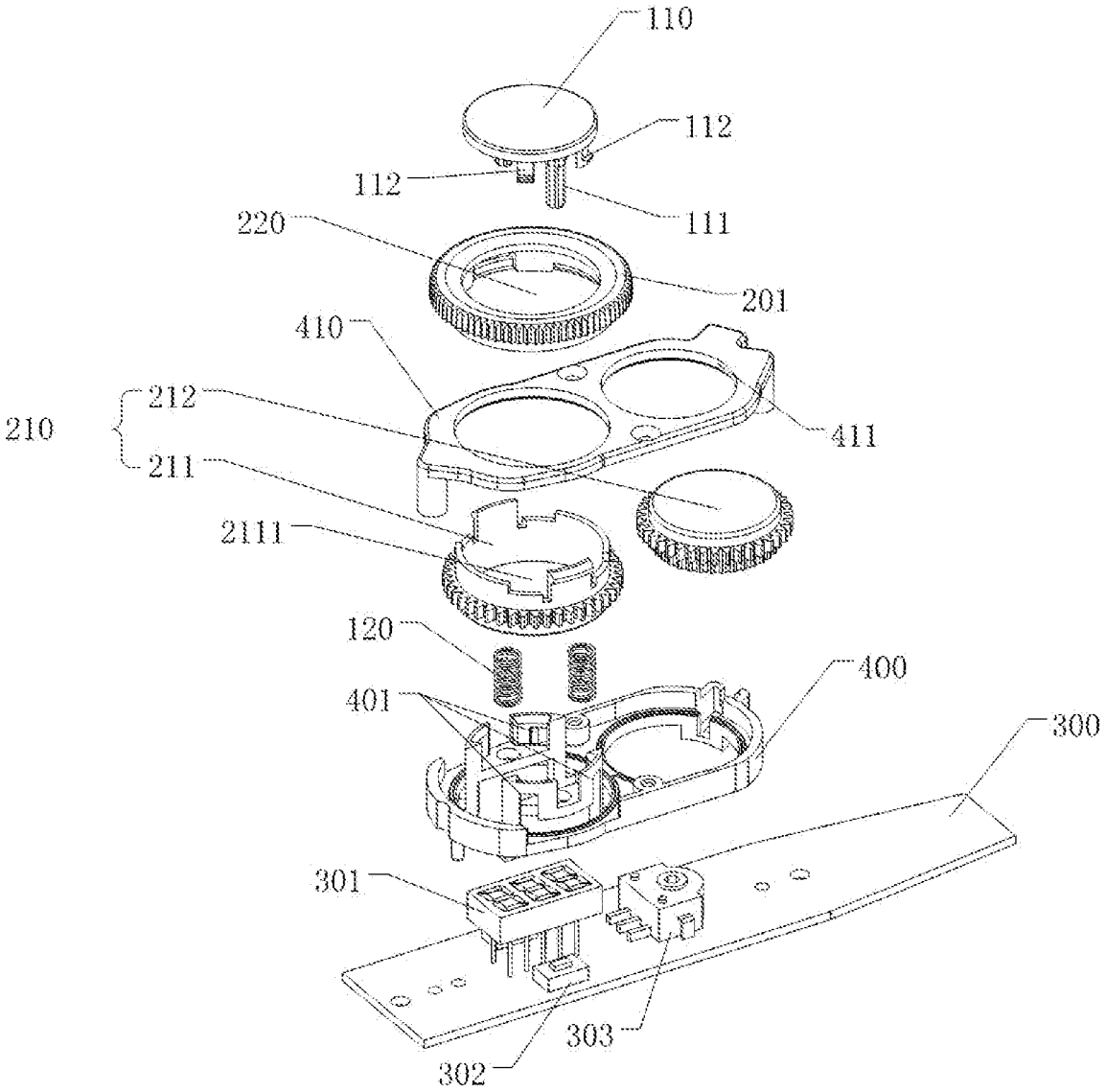
FIG. 2 is an explosion diagram of the integrated switch for control and display according to a first preferable embodiment of the present application.

Please referring FIGS. 1 and 2 together, in the integrated switch for control and display according to a preferable embodiment of the present application, the display button assembly 100 comprises a transparent/translucent display key 110, the control motherboard 300 is provided with a digital display tube 301 and the display key 110 is positioned directly above the digital display tube 301. Using the digital display tube 301 to replace the display screen (such as LCD) can greatly reduce hardware cost. Moreover, such alternative solution does not need the embedded redesign of micro display screen, effectively avoiding excessive production costs. Moreover, the display key 110 of the present application 1 is made of plastic material. The transparency of the display key 110 can be designed optionally as long as the user can clearly see the digital display below the display key 110.

Furthermore, the integrated switch for control and display further comprises an intermediate connecting member 400 sleeved on the digital display tube 301 and fixed on the control motherboard 300, wherein the display key 110 is mounted on the intermediate connecting member 400.

Furthermore, the control motherboard 300 is provided with a key switch element 302 while the display key 110 is provided with an abutting column 111 for abutting the key switch element 302. When the display key 110 is pressed by the user, it triggers the key switch element 302 through the abutting column 111 to control the power supply of the integrated switch for control and display. The key switch element 302, the digital display tube 301 and the control motherboard 300, as well as the connection relationship between them are common technical knowledge for one skilled in the art, and not described in detail here for concise.

Furthermore, the display key 110 is further arranged with a key buckle 112 for fixing while the intermediate connecting member 400 is corresponding arranged with a key clamping slot 401 for a fit connection with the key buckle 112 which is relatively slideable in the key clamping slot 401. In order to ensure the fixing, at least two key buckles 112/key clamping slots 401 can be arranged. In the present embodiment, four pairs of key buckle 112 and key clamping slot 401 are symmetrically arranged for stationary fit, which is more stable. The key clamping slot 401 has a certain slot length, so that when the key buckle 112 is snap-fitted with the key clamping slot 401, there is still a certain upper and lower displacement space for relative sliding of the key buckle 112, which enables the display key 110 to have restrictive upward and downward movements when the display key 110 is pressed.

Moreover, a spring 120 for automatic restoring the display key 110 is arranged between the display key 110 and the intermediate connecting member 400. In the present embodiment, there are two springs which are symmetrically arranged at both sides of the lower part of the display key 110.

In a preferable embodiment, the temperature control knob assembly 200 is arranged with an accommodation space 220 for accommodating the display button assembly 100. Such arrangement is conducive to the compactness and integration of the integrated switch for control and display.

In a preferable embodiment, the temperature control knob assembly 200 further comprises a temperature control knob 201 and an intermediate gear element 210; while the control motherboard 300 is provided with a rotary coding switch element 303 which is connected with the temperature control knob 201 through the intermediate gear element 210. When temperature control knob 201 rotates, such rotation would be transmitted to the rotary coding switch element 303 through the intermediate gear element 210, such that the mechanical motion is converted to the corresponding electrical signal, and then the temperature is changed by the rotary coding switch element 303.

Further, the intermediate gear element 210 comprises a main gear 211 and a secondary gear 212 which are meshed with each other, wherein the secondary gear 212 is provided with a polygonal prism 214 inserted into the rotary coding switch element 303. The temperature control knob 201 is fixed with the main gear 211 by a buckle. Both of the temperature control knob 201 and the main gear 211 are provided with a through-hole 2111 (that is the accommodation space) for accommodating the display key 110. The main gear 211 and the secondary gear 212 are arranged on the intermediate connecting member 400. In the present embodiment, the polygonal prism 214 is a hexagon prism.

In the first preferable embodiment of the present application, the intermediate gear element 210 further comprises a hand-feeling gear 213 mounted on the intermediate connecting member 400 and meshed with the main gear 211. Such hand-feeling gear 213 is mainly used to increase the rotation resistance of the temperature control knob 201, and prevent the rotation resistance of the temperature control knob 201 from being too small to cause the temperature control knob 201 to rotate easily in the non-human active operation which makes the temperature control unstable, thus ensuring the safety, stability and controllability of the product and further increasing the humanized setting of the product.

In the first preferable embodiment of the present application, the intermediate connecting member 400 further comprises a fixing cover 410 for fixing the main gear 211, the secondary gear 212 and the hand-feeling gear 213 and segregating the gear organization from the outside environment, thus facilitating the stable and effective operation of the intermediate gear element 210.

Figure 3:
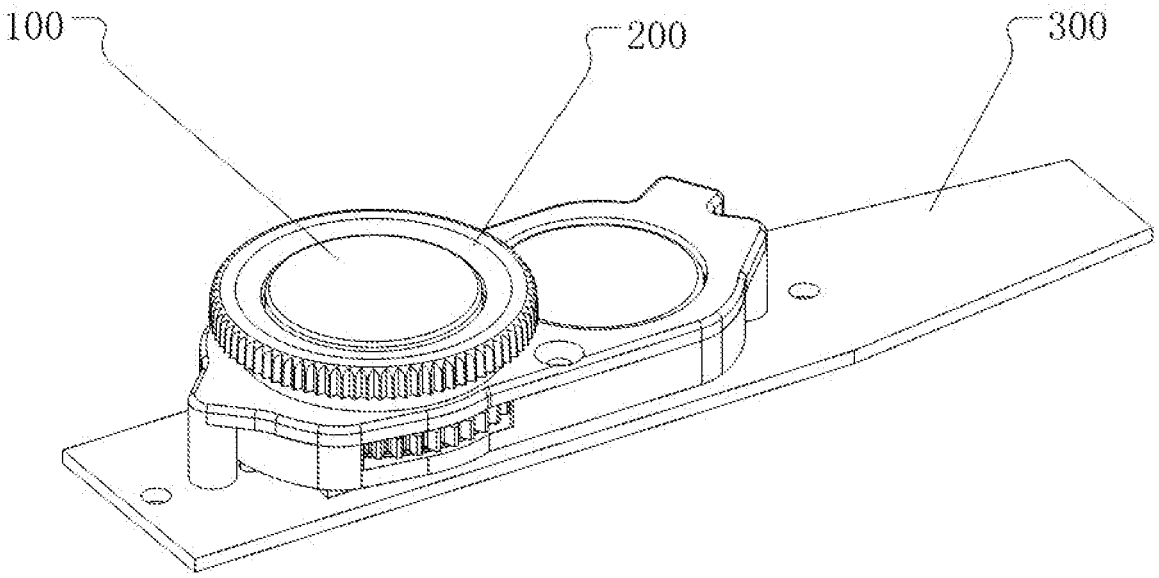
FIG. 3 is a schematic diagram of the integrated switch for control and display according to a second preferable embodiment of the present application.
Figure 4:
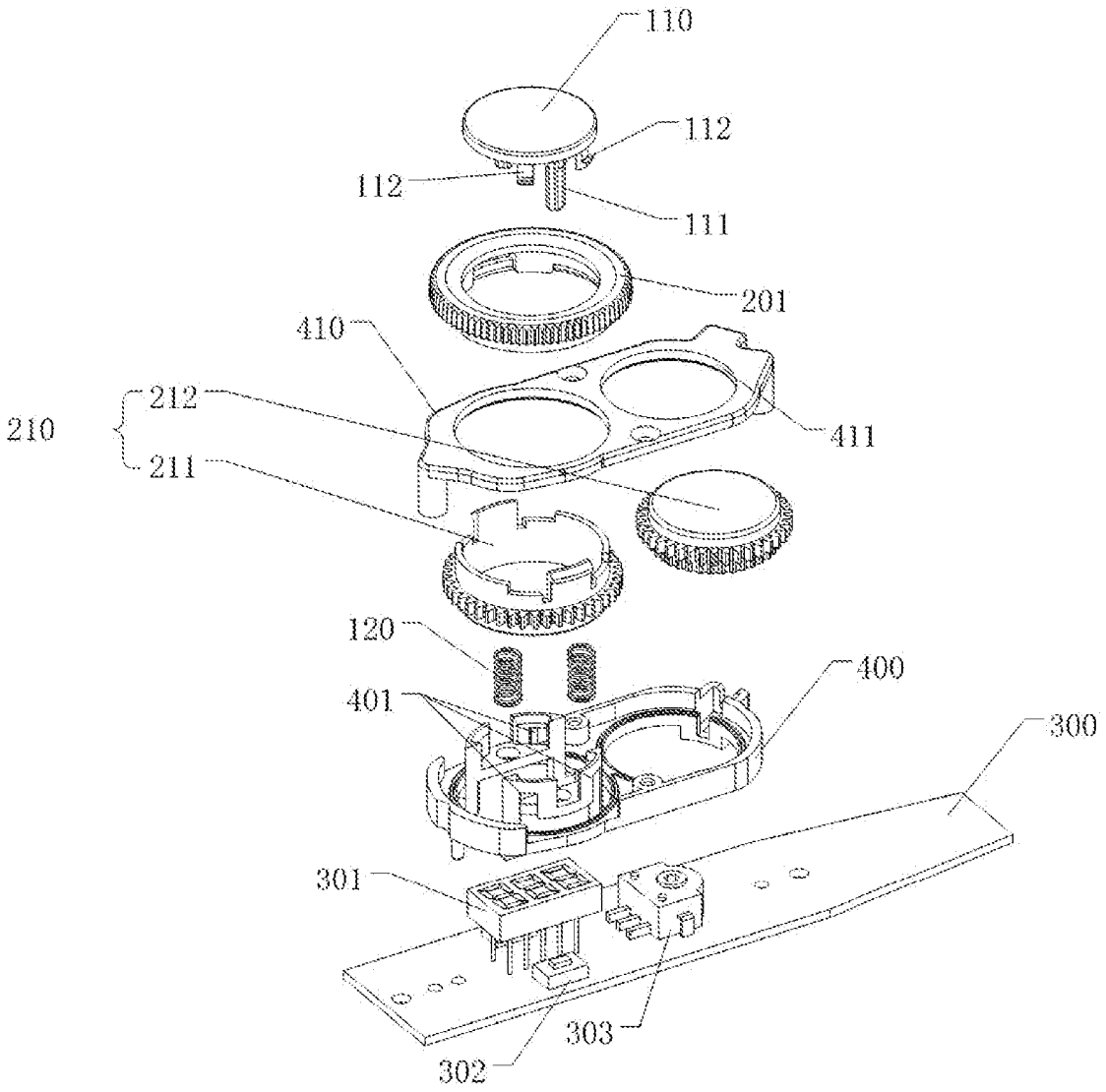
FIG. 4 is an explosion diagram of the integrated switch for control and display according to a second preferable embodiment of the present application.

More preferably, as shown in FIG. 3 and FIG. 4, in the secondary embodiment of the present application, in order to further simplify the structure, the hand-feeling gear 213 presented in the first embodiment is ignored, and meanwhile the diameter of the secondary gear 212 is increased to increase the rotary resistance of the temperature control knob 201. Moreover, in the second preferable embodiment of the present application, the intermediate connecting member 400 also comprises a fixing cover 410 arranged with a circular hole 411 in which the upper end of the secondary gear 212 is arranged. The arrangement of the circular hole 411 is for increasing the friction between the fixing cover 410 and the secondary gear 212 to ensure that the size of the secondary gear 212 can be minimized as far as possible while keeping the rotary resistance of the temperature control knob 201 is enough, thus the volume of the integrated switch for control and display can be reduced, and the production cost can also be further reduced.

Figure 5:
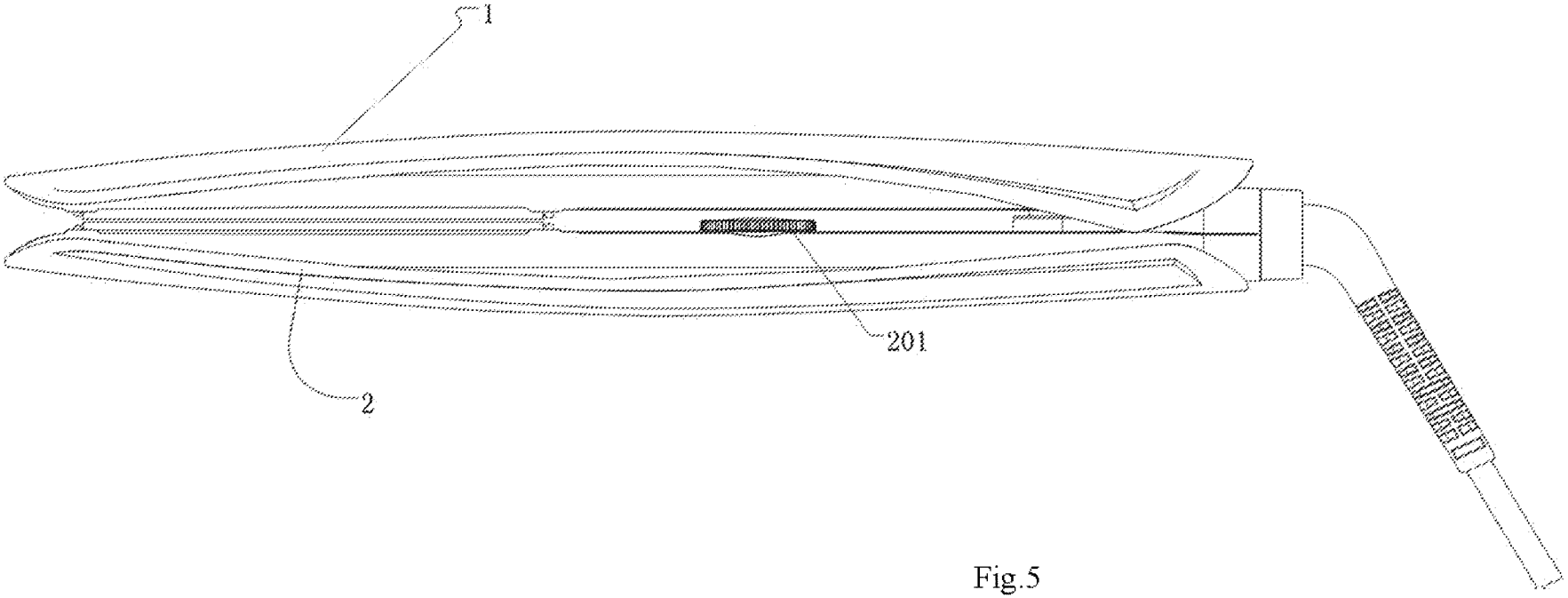
FIG. 5 is a schematic diagram showing the closing state of the hair straightener according to a preferable embodiment of the present application.

As shown in FIG. 5, based on the integrated switch for control and display, the present application has further provided a hair straightener comprising a first clamping plate part 1, a second clamping plate part 2 and the integrated switch for control and display discussed above, wherein the integrated switch for control and display is arranged on an inner side of the second clamping plate part 2 where is not the heating area. The specific arrangement position should be the place where the fingers of the user can touch when he/she operates the hair straightener with one hand. In addition, in order to ensure that the user can see the temperature display on the integrated switch for control and display smoothly, the angle limit between the first clamping plate part 1 and the second clamping plate part 2 should not be too small, so the specific arrangement position should be designed based on the actual size of the hair straightener. When the integrated switch for control and display is arranged on an inner side of the second clamping plate part 2, the temperature of the hair straightener can be conveniently controlled and regulated when it is operated by one hand, and the visual information of the real-time output temperature of the hair straightener can be obtained without obstacles. In additional, when the power supply is turned on or off, there is no need to regulate the operation position again, which greatly improves the simplicity and convenience of the one-hand operation, thus improving the market competitiveness of the hair straightener.

To sum up, in the present application, the temperature display and temperature control and regulation functions are centralized on the same switch key which further combines the power supply switching on and off functions. Furthermore, by means of a knob assembly, the temperature can be regulated linearly, which makes the control range more elaborate, and improves the humanized setting of the product. On the basis of the knob temperature regulation, the micro display function is added, so that the user can obtain real-time visual information of the temperature change while regulating the temperature. The integration of the two functions further increases the humanized settings. The integration of power switch on and off functions with the basic temperature display function can control the power supply to be switched on or off by pressing the switch key, which gives one switch key multiple functions and further increases the humanized settings. In addition, the integrated switch for control and display is arranged on an inner side of the clamping plate part, such that the temperature of the hair straightener can be controlled and regulated conveniently when it is operated by one hand, and meanwhile the visual information of the real-time output temperature can be obtained without obstacles. In additional, when the power supply is turned on or off, there is no need to regulate the operation position again, which greatly improves the simplicity and convenience of the one-hand operation, thus improving the market competitiveness of the hair straightener.

In additional, in the present application, the display button assembly comprises a transparent/translucent display key, the control motherboard is provided with a digital display tube and the display key is positioned directly above the digital display tube. Using the digital display tube to replace the display screen (such as LCD) can greatly reduce hardware cost. Moreover, such alternative solution does not need the embedded redesign of micro display screen, effectively avoiding excessive production costs.

It is understandable that for one skilled in the art, the technical solution and concept of the present application can be changed or modified, and all such changes and modifications should fall within the protection scope of the present application.

What is claimed is:

1. An integrated switch for control and display comprising a temperature control knob assembly for regulating and controlling temperature, a display button assembly for displaying the temperature and turning on or off a power supply, and a control motherboard for digital display and electrical control; wherein the temperature control knob assembly and the display button assembly are installed on the control motherboard;

wherein the temperature control knob assembly is arranged with an accommodation space for accommodating the display button assembly;

wherein the temperature control knob assembly further comprises a temperature control knob and an intermediate gear element while the control motherboard is provided with a rotary coding switch element which is connected with the temperature control knob through the intermediate gear element;

wherein the intermediate gear element comprises a main gear and a secondary gear which are meshed with each other, wherein the secondary gear is provided with a polygonal prism inserted into the rotary coding switch element, the temperature control knob is fixed with the main gear, and both of the temperature control knob and the main gear are provided with a through-hole for accommodating the display key, wherein the main gear and the secondary gear are arranged on the intermediate connecting member.

2. The integrated switch for control and display according to claim 1, wherein the display button assembly comprises a transparent/translucent display key, the control motherboard is provided with a digital display tube and the display key is positioned directly above the digital display tube.

3. The integrated switch for control and display according to claim 2, wherein further comprises an intermediate connecting member sleeved on the digital display tube and fixed on the control motherboard, wherein the display key is mounted on the intermediate connecting member.

4. The integrated switch for control and display according to claim 3, wherein the control motherboard is provided with a key switch element while the display key is provided with an abutting column for abutting the key switch element.

5. The integrated switch for control and display according to claim 4, wherein the display key is further arranged with a key buckle for fixing while the intermediate connecting member is corresponding arranged with a key clamping slot for a fit connection with the key buckle, wherein the key buckle is relatively slidable in the key clamping slot, wherein a spring for automatic restoring the display key is arranged between the display key and the intermediate connecting member.

6. The integrated switch for control and display according to claim 5, wherein two springs are symmetrically arranged at both sides of a lower part of the display key.

7. The integrated switch for control and display according to claim 5, wherein four pairs of key buckle and key clamping slot are symmetrically arranged.

8. The integrated switch for control and display according to claim 1, wherein the polygonal prism is a hexagon prism.

9. The integrated switch for control and display according to claim 1, wherein the intermediate gear element further comprises a hand-feeling gear mounted on the intermediate connecting member and meshed with the main gear.

10. The integrated switch for control and display according to claim 9, wherein the intermediate connecting member further comprises a fixing cover for fixing the main gear, the secondary gear and the hand-feeling gear.

11. The integrated switch for control and display according to claim 1, the intermediate connecting member further comprises a fixing cover arranged with a circular hole in which an upper end of the secondary gear is arranged.

12. A hair straightener comprising a first clamping plate part, a second clamping plate part and an integrated switch for control and display arranged on an inner side of the second clamping plate part; wherein the integrated switch for control and display comprises a temperature control knob assembly for regulating and controlling temperature, a display button assembly for displaying the temperature and turning on or off a power supply, and a control motherboard for digital display and electrical control; wherein the temperature control knob assembly and the display button assembly are installed on the control motherboard;

wherein the temperature control knob assembly is arranged with an accommodation space for accommodating the display button assembly;

wherein the temperature control knob assembly further comprises a temperature control knob and an intermediate gear element while the control motherboard is provided with a rotary coding switch element which is connected with the temperature control knob through the intermediate gear element;

wherein the intermediate gear element comprises a main gear and a secondary gear which are meshed with each other, wherein the secondary gear is provided with a polygonal prism inserted into the rotary coding switch element, the temperature control knob is fixed with the main gear, and both of the temperature control knob and the main gear are provided with a through-hole for accommodating the display key, wherein the main gear and the secondary gear are arranged on the intermediate connecting member.

13. The hair straightener according to claim 12, wherein the display button assembly comprises a transparent/translucent display key, the control motherboard is provided with a digital display tube and the display key is positioned directly above the digital display tube.

14. The hair straightener according to claim 13, wherein the integrated switch for control and display further comprises an intermediate connecting member sleeved on the digital display tube and fixed on the control motherboard, wherein the display key is mounted on the intermediate connecting member.

15. The hair straightener according to claim 14, wherein the control motherboard is provided with a key switch element while the display key is provided with an abutting column for abutting the key switch element.

16. The hair straightener according to claim 15, wherein the display key is further arranged with a key buckle for fixing while the intermediate connecting member is corresponding arranged with a key clamping slot for a fit connection with the key buckle, wherein the key buckle is relatively slidable in the key clamping slot, wherein a spring for automatic restoring the display key is arranged between the display key and the intermediate connecting member.

* * * * *